US009204740B1

(12) United States Patent
Wersland

(10) Patent No.: US 9,204,740 B1
(45) Date of Patent: Dec. 8, 2015

(54) PROTECTIVE GARMENT STORAGE SYSTEMS

(76) Inventor: Mikal Wersland, Bountiful, TN (US)

( * ) Notice: Subject to any disclaimer, the term of this patent is extended or adjusted under 35 U.S.C. 154(b) by 1240 days.

(21) Appl. No.: 12/012,512

(22) Filed: Jan. 31, 2008

Related U.S. Application Data

(60) Provisional application No. 60/898,950, filed on Jan. 31, 2007.

(51) Int. Cl.
*A47F 8/02* (2006.01)

(52) U.S. Cl.
CPC ..... *A47F 8/02* (2013.01)

(58) Field of Classification Search
CPC ..... A47F 8/02; A47F 7/19; A47B 61/00; A47G 25/24; A47G 25/28; A47G 25/20
USPC ..... 223/1, 66, 69, 68, 85, 92; 211/12, 211/85.15, 85.31, 33, 181.1
See application file for complete search history.

(56) References Cited

U.S. PATENT DOCUMENTS

| | | | | | |
|---|---|---|---|---|---|
| 666,809 | A | * | 1/1901 | Kessels | 223/68 |
| 1,254,719 | A | | 1/1918 | Moschcowitz | |
| 1,332,146 | A | | 2/1920 | Riordan et al. | |
| 1,563,659 | A | * | 12/1925 | Riordan et al. | 223/68 |
| 2,060,395 | A | * | 11/1936 | Irwin et al. | 223/69 |
| 2,108,308 | A | * | 2/1938 | Dickey | 223/69 |
| 2,285,376 | A | * | 6/1942 | Lovell | 223/68 |
| 2,646,907 | A | | 7/1953 | Clawsey et al. | |
| 2,666,559 | A | * | 1/1954 | Wexler et al. | 223/68 |
| 2,796,206 | A | | 6/1957 | Schwartz | |
| 2,814,424 | A | * | 11/1957 | Wexler et al. | 223/68 |
| 2,998,903 | A | | 9/1961 | Day | |
| 3,043,423 | A | * | 7/1962 | Shenker | 206/289 |
| D195,069 | S | * | 4/1963 | Zuckerman | D6/316 |
| 3,737,079 | A | * | 6/1973 | Bliss | 223/68 |
| 4,074,838 | A | * | 2/1978 | Blasnik et al. | 223/85 |
| 4,109,838 | A | | 8/1978 | Dwek | |
| 4,526,306 | A | * | 7/1985 | Zuckerman et al. | 223/88 |
| 4,728,016 | A | * | 3/1988 | McPhee | 223/85 |
| 5,018,649 | A | | 5/1991 | Ventimiglia | |
| 5,127,559 | A | * | 7/1992 | Freer et al. | 223/85 |
| 5,244,131 | A | | 9/1993 | Hollingsworth | |
| 5,265,779 | A | | 11/1993 | Jiang | |
| 5,996,948 | A | * | 12/1999 | Skvorecz | 248/153 |
| 6,438,853 | B1 | | 8/2002 | Gordon et al. | |
| 6,454,145 | B1 | | 9/2002 | Russ | |
| 6,758,378 | B2 | | 7/2004 | Carmichael | |
| 2004/0222249 | A1 | * | 11/2004 | Bentham et al. | 223/66 |
| 2004/0232177 | A1 | * | 11/2004 | Neiffer | 223/66 |
| 2006/0097016 | A1 | | 5/2006 | Nan | |
| 2006/0097018 | A1 | | 5/2006 | Cresap et al. | |

OTHER PUBLICATIONS

The American Heritage Dictionary of the English Language, Fourth Edition copyright © 2000 by Houghton Mifflin Company. Updated in 2009. Published by Houghton Mifflin Company. All rights reserved. [taken from http://www.thefreedictionary.com/nested].*

* cited by examiner

*Primary Examiner* — Shaun R Hurley
*Assistant Examiner* — Andrew W Sutton
(74) *Attorney, Agent, or Firm* — Thorpe North & Western, LLP

(57) ABSTRACT

A combination protective garment and storage rack comprises a protective garment being operable to resist penetration therethrough of projectiles and having an expanded configuration wherein an inner contour of the garment corresponds to the shape of a human torso. A storage rack has a contoured frame with an external contour that corresponds to the inner contour of the garment.

20 Claims, 6 Drawing Sheets

PROTECTIVE GARMENT STORAGE SYSTEMS

Priority is claimed of U.S. Provisional Patent Application No. 60/898,950, filed Jan. 31, 2007, which is hereby incorporated herein by reference in its entirety.

BACKGROUND OF THE INVENTION

1. Field of the Invention

The present invention relates generally to systems for storing protective garments, such as bulletproof vests, "flak" jackets and vests, and the like.

2. Related Art

Protective garments, such as "flak jackets" or bulletproof vests, are often worn by those in law enforcement, personnel protection, and military operations for protection from bullets and shrapnel. Generally, such vests are worn close to the wearer's body and beneath the wearer's clothes. It will be appreciated that such vests can be heavy and bulky and can add additional layers of covering to the wearer's body, thereby reducing ventilation and increasing the likelihood of perspiration by the wearer. Thus, when the vest is doffed, it is very often wet with perspiration and should be allowed to dry and/or ventilated so as to maintain the hygiene and cleanliness of the vest.

However, such vests are generally not self supporting and so often simply lay flat when rested upon a shelf or in a locker. Because the vests are heavy and bulky, hanging the vest on a standard coat hanger can cause the vest to stretch or deform: hanging the vest in such a manner can even void the manufacturer's warranty of the vest. Additionally, conventional hangers are not generally strong enough to support the weight of the vest and will collapse or bend when weighted, causing the vest to fold in on itself, thereby reducing or eliminating proper ventilation of internal portions of the vest.

SUMMARY OF THE INVENTION

It has been recognized that it would be advantageous to develop a system to allow proper ventilation of a protective garment during storage of the garment. In addition, it has been recognized that it would be advantageous to develop a system for storing protective garments such that the weight and bulk of the garment does not induce damage to the garment while it is stored.

The invention provides a protective garment storage rack, including a first contoured frame and a second contoured frame corresponding in size and shape to the first contoured frame. The first contoured frame can be positionable with respect to the second contoured frame in: an orientation opposing the second contoured frame to form a bodice framework contoured to correspond to a shape of a human torso, and forming an internal airflow cavity between the first contoured frame and second contoured frame, the airflow cavity being configured to allow air to flow around an inside of a protective garment placed over the rack; and a nesting orientation within the second contoured frame to allow the frames to be nested relative to each other for shipping and storage.

In accordance with another aspect of the invention, a combination protective garment and storage rack is provided, including a protective garment being operable to resist penetration therethrough of projectiles and having an expanded configuration wherein an inner contour of the garment corresponds to the shape of a human torso. A storage rack can be used to store the garment and can have a contoured frame with an external contour that corresponds to the inner contour of the garment.

In accordance with another aspect of the invention, a protective garment storage rack is provided, including a framework contoured to correspond to a human torso. The framework can include series of supports defining therebetween a series of cavities to allow airflow through the series of supports. A combined surface area of the supports can be less than about 20% of a total surface area of the storage rack.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1:
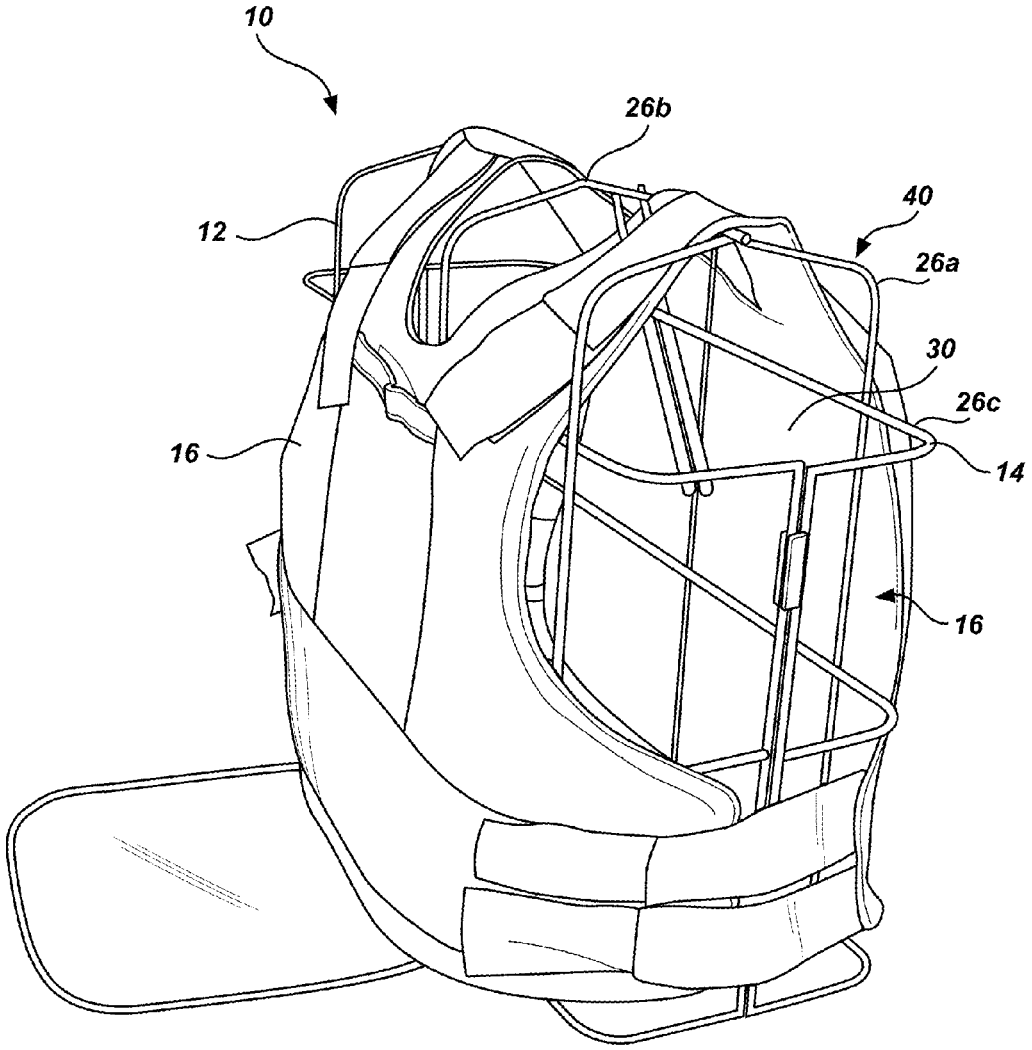
FIG. 1 is a perspective view of a protective garment storage rack having a protective vest stored thereon in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

It must be noted that, as used in this specification and the appended claims, the singular forms "a" and "the" include plural referents, unless the context clearly dictates otherwise. Thus, for example, reference to a "support" can include one or more of such supports.

Distances, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the explicitly recited values of about 1 inch to about 5 inches, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value and should apply regardless of the breadth of the range or the characteristics being described.

INVENTION

The present invention generally provides a storage rack sized and shaped to securely hold a protective garment, such as a bulletproof vest, flak jacket or the like. The storage rack advantageously includes a contoured shape that mimics or corresponds to the human torso. In this manner, the protective garment can be stored while maintained in a shape that corresponds to the shape in which the garment will be held when in use. The present invention can thereby greatly increase the useful life of the protective garment and minimize damage that would otherwise be caused to the garment if it were hung from a hook, a conventional hanger, or simply laid down upon a surface.

Figure 2:
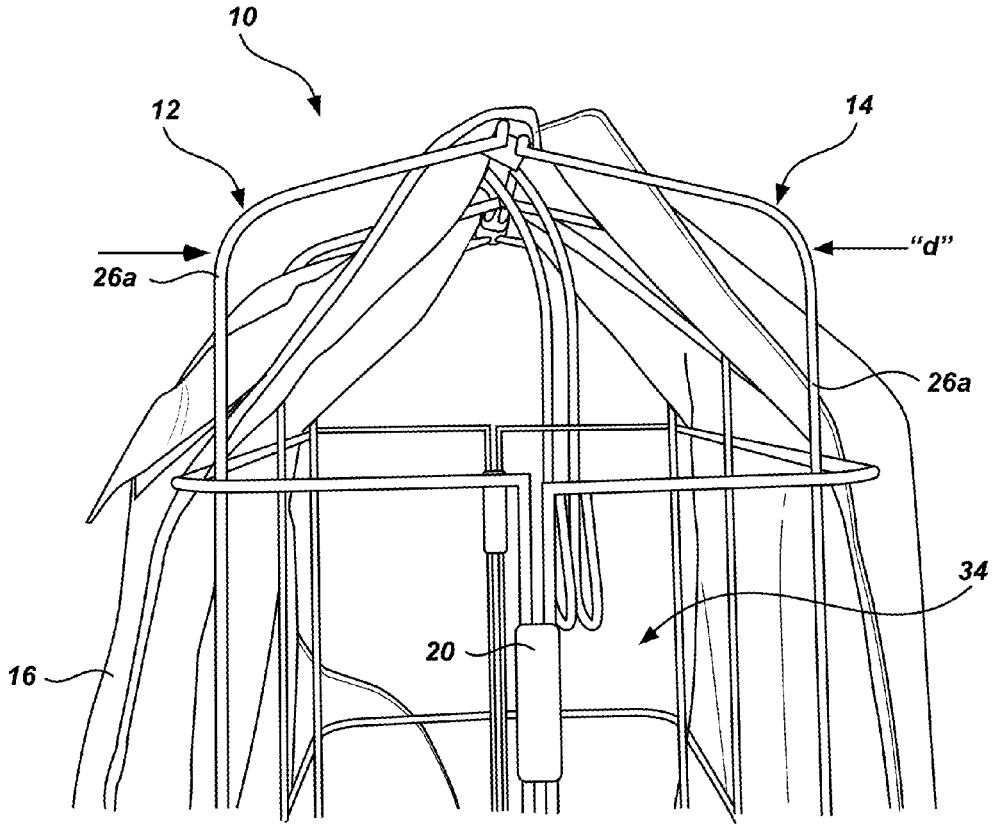
FIG. 2 is a side view of the vest and storage rack of FIG. 1.
Figure 3:
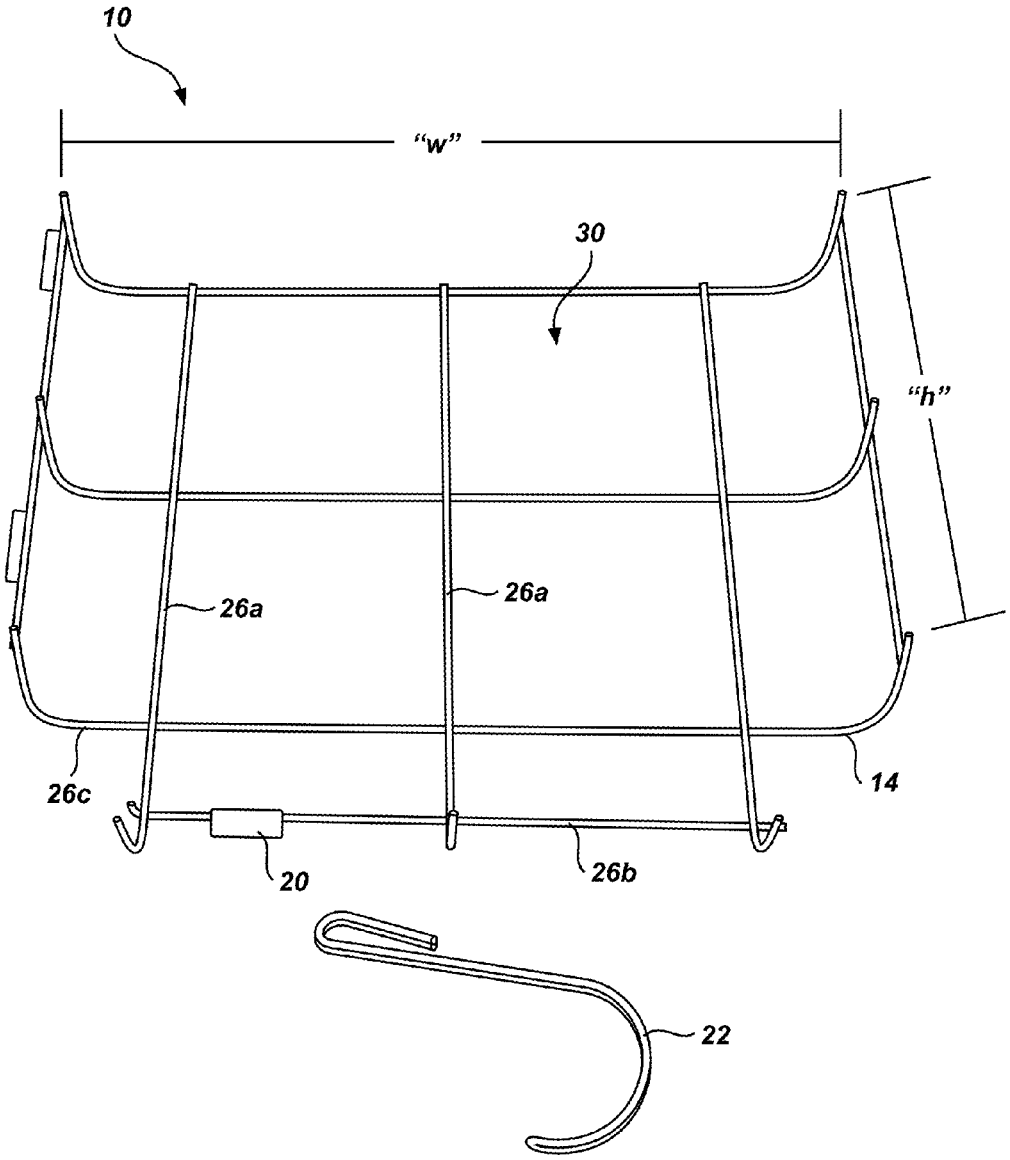
FIG. 3 is a perspective view of the components of the protective garment storage rack of FIG. 1, shown in a dissembled condition.

As shown generally in the attached figures, and with specific reference to FIGS. 1, 2 and 3, in one aspect of the invention a protective garment storage rack 10 is provided that can include a first contoured frame 12 and a second contoured frame 14. The second contoured frame can generally correspond in size and shape to the first contoured frame. The first contoured frame can be positionable with respect to the second contoured frame in at least two primary configurations. In one configuration, shown in FIGS. 1 and 2, the first contoured frame can be oriented opposing the second contoured frame in order to form a bodice framework that is contoured to correspond to a shape of a human torso. This configuration is illustrated in FIGS. 1 and 2, with an exemplary protective vest 16 shown supported by the bodice framework.

Figure 6:
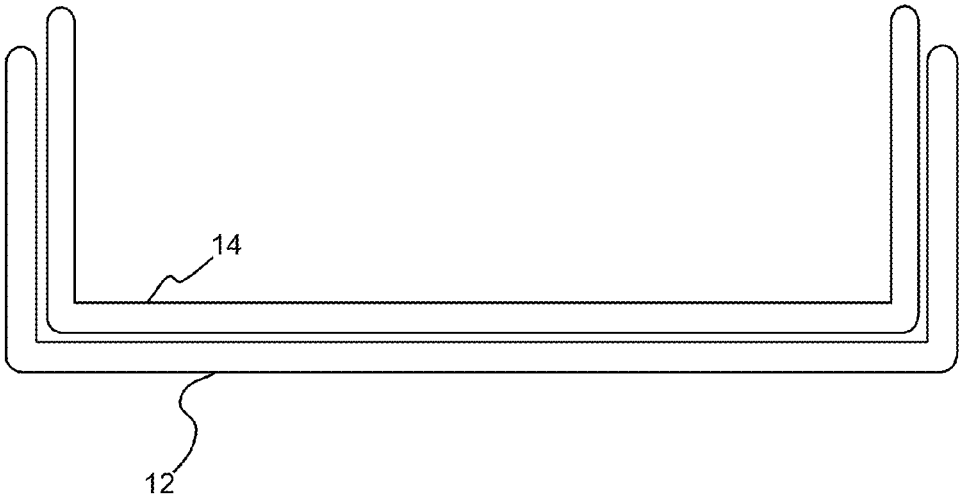
FIG. 6 is a schematic view of two exemplary contoured frames shown in a nesting orientation.

The second configuration of the first 12 and second 14 contoured frames will be appreciated by those of ordinary skill in the art by review of FIG. 3. FIG. 3 illustrates each of the various components of the system in a disassembled condition, including first frame 12, second frame 14, a series of connectors 20, and a hanger 22. The second configuration (shown schematically in FIG. 6) is a nesting orientation in which one of the first 12 or second 14 contoured frames is nested within a second of the contoured frames, such that the two frames collectively consume only slightly more space than does any single frame by itself. This aspect of the invention is advantageous in that packaging, shipping, displaying, etc., of the structure can be done in a much more compact and space-efficient manner.

As will also be appreciated from FIGS. 1, 2 and 3 (particularly FIG. 3), each of the first 12 and second frames includes a series of supports 26 that provide structural strength to the frames. The supports define therebetween a series of cavities 30 that allow significant airflow through the frames into and out of an internal airflow cavity (34 in FIG. 2) between the first contoured frame and second contoured frame. This relationship provides excellent airflow to and around an inside of the vest 16 stored on the rack 10. In this manner, the vest can quickly dry when stored after use, and can be retained in the proper shape while drying.

The present inventor has previously found a lack of adequate options for storing protective garments such as flak vests or jackets, "bullet-proof" vests, body armor, etc. Such garments very often include straps that extend over the shoulders of the wearer, as well as straps that extend about the torso of the wearer. These straps work in concert to secure the protective garment about the wearer, while also minimizing stress concentrations at any particular strap location. This system has been found to work well when the garment is donned by the wearer. However, when the garment is doffed, storage becomes problematic in that hanging the garment from conventional hangers can add undesirably high stress loads to the shoulder straps of the garment, thus risking damage to the garment (some manufacturers explicitly state that such storage can void the manufacturer's warranty).

The present invention addresses these problems by providing a storage system that replicates the conditions under which the protective garment is intended to be used. In other words, the protective garment is held in substantially the same orientation and configuration during storage as it encounters during use. In this manner, damage to the garment during storage is minimized, while at the same time maximizing the airflow in and around the garment to allow the garment to dry.

In one aspect of the invention, the bodice framework includes an upper shoulder support area (shown generally at 40 in FIGS. 1 and 2) that can include a depth "d" at least about ¼ of a width ("w" in FIG. 3) of the storage rack. In this manner, the upper shoulder support area provides an expanded support area for straps (or other structure of the garment) that is similar to the support surface of a wearer's shoulders. As opposed to a substantially "point" load that would applied by a conventional hanger, this expanded support area does not unduly stress the straps of the garment. Depending upon the configuration of the garment being stored on the rack, the upper shoulder support area can include the upper portions of "vertical" supports 26*a* (FIGS. 2 and 3) and "horizontal" supports 26*b* (FIGS. 1, 2 and 3) and 26*c* (FIGS. 1, 2 and 3). In addition, further horizontal supports can be added to the system, at the bent areas of supports 26*a*, to provide additional support to the upper shoulder support area.

In one aspect of the invention, the upper shoulder support area 40 can include a depth "d" at least about ¼ of a height "h" (FIG. 3) of the storage rack. As in the previously discussed embodiment, this aspect of the invention ensures that ample support is provided to the protective garment as it is stored on the rack, including support at the upper should portions, and about the torso portion of the garment. In one aspect of the invention, as illustrated by example in FIG. 2, the upper shoulder support area includes a contact profile which supports the vest (in this case, supports 26*b* (FIG. 1) and 26*a* that supports an upper shoulder portion of the garment at an angle greater than about 45 degrees relative to an upright axis of the rack. This angle at which the shoulder portions of the garment are supported can vary, but will generally be between about 90 degrees relative to the upright axis (e.g., horizontal) and about 30 degrees relative to the upright axis.

The present invention advantageously provides a great deal of airflow through the framework of the storage rack. In one aspect of the invention, this advantage is provided by presenting a large degree of cavity 30 surface area relative to the surface area consumed by the supports. In one aspect of the invention, the surface area consumed by the supports is less than about 10%-20% of a total surface area of the area of the frames. In other words, if a frame surface were about 16 inches by 18 inches, the total surface area would be around 288 $in^2$, with the supports consuming less than 10%-20% of this total. In one exemplary embodiment, the supports are formed from 4 mm gauge heavy-duty wire, and are spaced from one another such that cavity 30*a* (for example) of FIG. 3 defines an opening of about 6 inches×6 inches.

Figure 4:
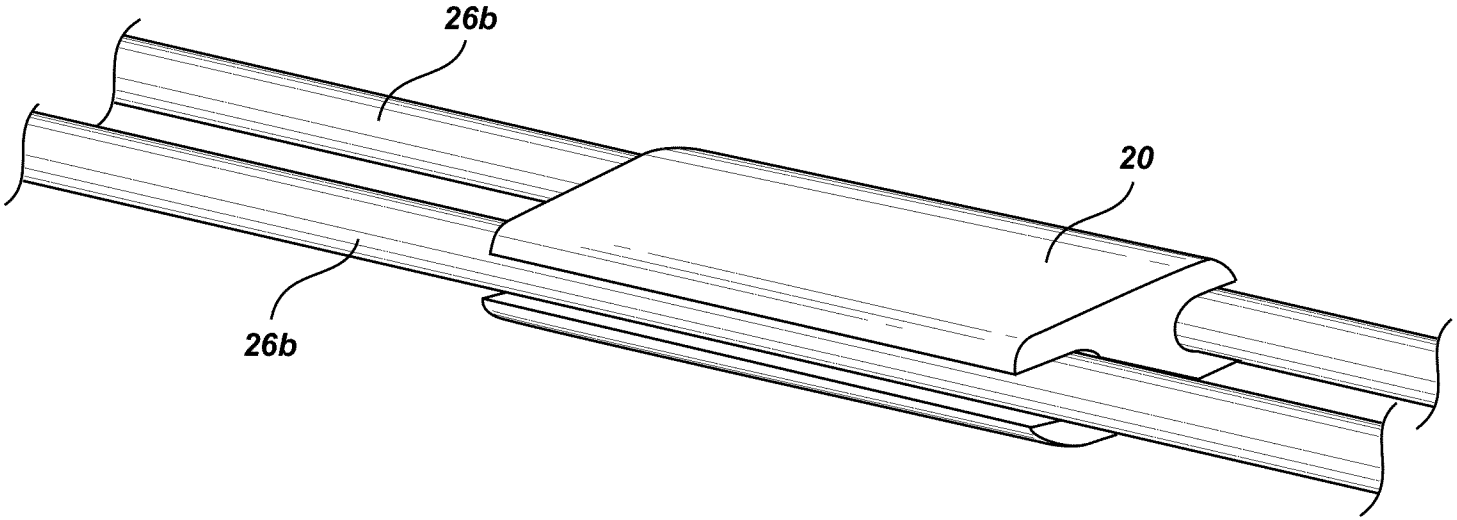
FIG. 4 is partial perspective view of two components of the protective garment storage rack of FIG. 1 coupled to one another by a connector in accordance with one embodiment of the invention.

FIG. 4 provides a more detailed view of one of the plurality of connectors 20 shown in FIG. 3. The connector can be used to snap-fit two components of the storage rack to one another (e.g., one upper support 26*b* from each of the frames can be coupled to one another). The connectors generally include a pair of elongate channels that are sized slightly smaller than the supports, such that some degree of force is required engage the supports within the channels. The connectors provide a secure coupling between the components, while also relatively easy disassembly of the entire rack for storage, packaging, shipping, etc.

Figure 5A:
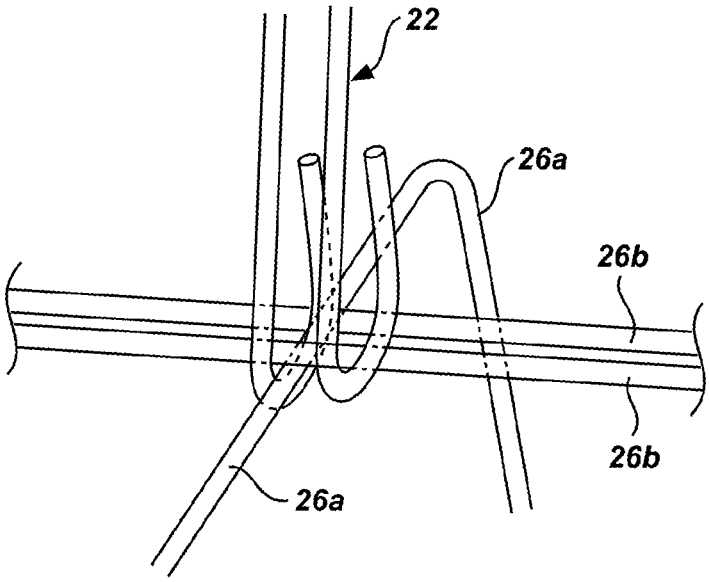
FIG. 5A is a partial perspective view of two components of the protective garment storage rack of FIG. 1, shown with a hanger engaged therewith in one exemplary orientation.
Figure 5B:
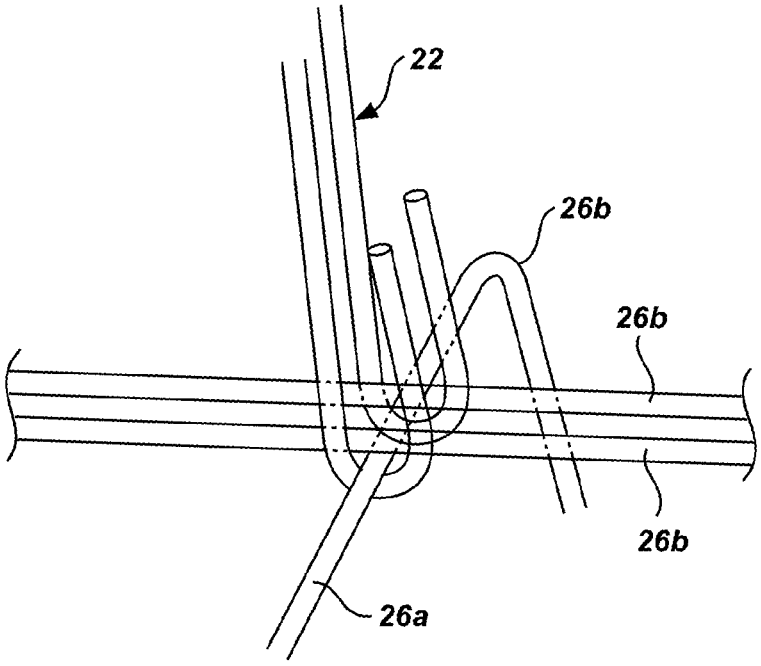
FIG. 5B is a partial perspective view of the components of FIG. 5A, with the hanger engaged therewith in an orientation 90 degrees rotated from that shown in FIG. 5A.

FIGS. 5A and 5B illustrate further aspects of the invention in which hanger 22 can be removably coupleable to the rack and can also be rotatable with respect to the rack, to enable hanging of the rack in either of two orientations. In the embodiment illustrated in FIG. 5A, the hanger is rotated such that "horizontal" supports 26*a* extend between prongs of the hanger, while hooked portions of the hanger circumscribe "horizontal" supports 26*b*. In this manner, one component from each of the first 12 and second 14 frames (FIG. 3) is cradled within the hook portions of the hanger. The hanger can advantageously be removed from the orientation shown in FIG. 5A, however, and quickly and easily be re-engaged with the storage rack in the orientation shown in FIG. 5B. In this orientation, both "horizontal" supports 26*b* extend between the prongs, while one each of "vertical" supports are cradled within the hook portions of the hanger.

The storage rack 10 can be provided in a variety of configurations and sizes. Generally speaking, however, the rack is sized to accommodate the storage of protective garments that fit a wide range of body types. In one aspect of the invention, the storage rack 10 includes a depth "d" of at least about 6 inches, a width "w" of at least about 16 inches, and a height "h" of at least about 18 inches. These dimensions are exemplary only, it being understood that the support rack can be provided in a variety of sizes. Generally, however, it is the case that the depth dimension of the rack will be at least about ¼ of a height or a width of the device, it being generally advantageous to provide a wide support base for the shoulder portion of the protective garment being held.

The generally trunk-like shape of the storage rack provides a number of advantages. As discussed above, the upper shoulder support 40 can provide one or more generally planar surfaces to maintain upper should portions of the protective garment in an orientation that mimics the orientation of the garment when donned by a wearer. The central portion of the storage rack (shown generally at 60 in FIG. 1) provides a similar benefit: the straps of the protective garment can be secured about the central portion of the rack to further mimic the support given to the protective garment while in use on a wearer. In this manner, no stresses or strains are applied to the garment when in storage that differ significantly from those stresses or strains it experiences while in use (in other words, the stresses and strains for which the garment has been specifically designed to withstand).

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A protective garment storage rack, comprising:

a first contoured frame;

a second contoured frame, separable from the first contoured frame, the second contoured frame corresponding in size and shape to the first contoured frame;

the first contoured frame being coupled to the second contoured frame in an orientation opposing the second contoured frame to form a bodice framework contoured to correspond to a shape of a human torso, and forming an internal airflow cavity between the first contoured frame and second contoured frame, the airflow cavity being configured to allow air to flow around an inside of a protective garment placed over the rack;

the first contoured frame being separable from the second contoured frame and positionable in a nesting orientation within the second contoured frame to allow the frames to be nested relative to each other for shipping and storage; and at least one connector, operable to be attached to each of the contoured frames to enable coupling of the contoured frames to one another, the connector including a pair of elongate channels operable to engage the contoured frames.

2. The storage rack of claim 1, wherein the bodice framework includes an upper shoulder support area having a depth at least ¼ of a width of the upper shoulder support area.

3. The storage rack of claim 1, wherein the bodice framework includes an upper shoulder support area having a depth at least ¼ of a height of the bodice framework.

4. The storage rack of claim 2, wherein the upper shoulder support area includes a contact profile which supports the vest, the contact profile operable to support an upper shoulder portion of the vest at an angle greater than 45 degrees relative to an upright axis of the rack.

5. The storage rack of claim 1, wherein the first and second contoured frames each include a series of supports defining therebetween a series of cavities to allow airflow through the series of supports, and wherein a combined surface area of the supports is less than 10% of a total combined surface area of the frames.

6. The storage rack of claim 1, further comprising a hanger, removably coupleable to the rack and rotatable with respect to the rack, to enable hanging of the rack in either of two orientations.

7. A combination protective garment and storage rack, comprising:

a protective garment being operable to resist penetration therethrough of projectiles and having an expanded configuration wherein an inner contour of the garment corresponds to the shape of a human torso;

a storage rack having an external contour that corresponds to the inner contour of the garment, the storage rack including:

a first contoured frame;

a second contoured frame, separable from the first contoured frame, the second contoured frame corresponding in size and shape to the first contoured frame;

the first contoured frame being coupled to the second contoured frame in an orientation opposing the second contoured frame to form a bodice framework contoured to correspond to a shape of a human torso, and forming an internal airflow cavity between the first contoured frame and second contoured frame, the airflow cavity being configured to allow air to flow around an inside of a protective garment placed over the rack;

the first contoured frame being separable from the second contoured frame and being positionable in a nesting orientation within the second contoured frame to allow the frames to be nested relative to each other for shipping and storage; and at least one snap-fit connector including a pair of elongate channels, operable to be attached to each of the contoured frames to enable coupling of the contoured frames one to another, the snap-fit connector being snap-fit to one or both of the contoured frames.

8. The combination of claim 7, wherein the storage rack includes an upper shoulder support area having a depth at least ¼ of a width of the upper shoulder support area.

9. The combination of claim 7, wherein the storage rack includes an upper shoulder support area having a depth at least ¼ of a height of the storage rack.

10. The combination of claim 7, wherein the storage rack includes an upper shoulder support area having a substantially planar support profile, to provide support to upper shoulder portions of the protective garment.

11. The combination of claim 10, wherein the upper shoulder support area includes a contact profile which supports the vest, the contact profile operable to support an upper shoulder portion of the vest at an angle greater than 45 degrees relative to an upright axis of the storage rack.

12. The combination of claim 7, wherein the storage rack includes a series of supports defining therebetween a series of cavities to allow airflow through the series of supports, and wherein a combined surface area of the supports is less than 20% of a total surface area of the storage rack.

13. A protective garment storage rack, comprising:

a framework contoured to correspond to a human torso, the framework comprised of a series of supports defining therebetween a series of cavities to allow airflow through the series of supports; wherein a combined surface area of the supports is less than 20% of a total surface area of the storage rack; wherein the framework includes:

a first contoured frame;

a second contoured, separable from the first contoured frame, the second contoured frame corresponding in size and shape to the first contoured frame;

the first contoured frame being coupled to the second contoured frame an orientation opposing the second contoured frame to form a bodice framework contoured to correspond to a shape of a human torso, and forming an internal airflow cavity between the first contoured frame and second contoured frame, the airflow cavity being configured to allow air to flow around an inside of a protective garment placed over the rack;

the first contoured frame being separable from the second contoured frame and being positionable in a nesting orientation within the second contoured frame to allow the frames to be nested relative to each other for shipping and storage; and a plurality of snap-fit connectors arranged about the storage rack, the snap-fit connectors being operable to be attached to each of the contoured frames to enable coupling of the contoured frames one to another, each of the snap-fit connectors including a pair of elongate channels operable to engage the contoured frames.

14. The storage rack of claim 13, wherein the storage rack includes an upper shoulder support area having a depth at least ¼ a width of the upper shoulder support area.

15. The storage rack of claim 14, wherein the upper shoulder support area includes a contact profile which supports the vest, the contact profile operable to support an upper shoulder portion of the vest at an angle greater than 45 degrees.

16. The storage rack of claim 1, wherein each of the at least one connectors comprises a snap-fit connector, the snap-fit connector being snap-fit to one or both of the contoured frames.

17. The storage rack of claim 16, further comprising a plurality of snap-fit connectors, arranged about the storage rack.

18. The storage rack of claim 7, wherein each of the snap-fit connectors includes a pair of elongate channels operable to engage the contoured frames.

19. The storage rack of claim 18, further comprising a plurality of snap-fit connectors, arranged about the storage rack.

20. The storage rack of claim 13, wherein the pair of elongate channels are arranged on opposing sides of the snap-fit connectors.

* * * * *